US006452106B1

(12) United States Patent
Hase et al.

(10) Patent No.: US 6,452,106 B1
(45) Date of Patent: Sep. 17, 2002

(54) RESIN COMPOSITION, METHOD OF MAKING IT AND ELECTRICAL WIRE COVERED WITH IT

(75) Inventors: Tatsuya Hase, Yokkaichi (JP); Masashi Sato, Yokkaichi (JP); Hiroshi Fujimoto, Yokkaichi (JP)

(73) Assignees: Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/770,499

(22) Filed: Jan. 29, 2001

(51) Int. Cl.[7] ..... H01B 3/44

(52) U.S. Cl. ..... 174/110 SR; 174/110 R; 428/379; 428/403; 523/213; 524/436; 524/437; 525/74; 525/88; 525/191; 525/193

(58) Field of Search ..... 428/379, 403; 174/110 R, 120 R, 110 SR; 524/437, 436; 525/74, 88, 191, 193; 523/213

(56) References Cited

U.S. PATENT DOCUMENTS 5,139,875 A * 8/1992 Metzemacher et al.
5,180,889 A 1/1993 Rogers et al.
5,211,746 A * 5/1993 Keogh et al.
5,561,185 A 10/1996 Hashimoto et al.
6,190,772 B1 * 2/2001 Yamano et al.

FOREIGN PATENT DOCUMENTS

| | | | |
|---|---|---|---|
| EP | 0 273 516 A2 | | 7/1988 |
| EP | 0 973 174 A1 | | 1/2000 |
| JP | A-6-290638 | | 10/1994 |
| JP | A-7-78518 | | 3/1995 |
| JP | A-7-176219 | | 7/1995 |
| JP | 8-300563 A | * | 11/1996 |
| JP | 2001-002839 | * | 1/2001 |

* cited by examiner

*Primary Examiner*—Robert Dawson
*Assistant Examiner*—Marc S Zimmer
(74) *Attorney, Agent, or Firm*—Oliff & Berridge, PLC

(57) ABSTRACT

A resin composition contains (a) 40–90 parts by weight of a block copolymer of polypropylene segments and ethylene-propylene copolymer segments which is modified with an acid anhydride, in which the polypropylene segment content is in the range 5 to 50 wt %, (b) 60–10 parts by weight of a styrene-based polymeric elastomer, or a styrene-based elastomer modified with an acid anhydride, and (c) 30–200 parts by weight of a metal hydroxide per 100 parts by weight of (a) and (b). This wear resistant halogen-free resin composition has high mechanical strength and flexibility and is suitable for extruding as an electrical wire covering for example for a wire used in an automobile.

27 Claims, No Drawings

RESIN COMPOSITION, METHOD OF MAKING IT AND ELECTRICAL WIRE COVERED WITH IT

BACKGROUND OF THE INVENTION

1. Field of Invention

This invention relates to a halogen-free resin composition containing metal hydroxide, to a method of making the resin composition and to electrical wire having this resin composition as a covering on an electrical conductor core. Such an electrical wire is useful, for example, in a motor vehicle.

2. Description of Related Art

Polyvinyl chloride has been widely used as the covering material of electrical wire for an automobile, because it is superior in properties such as mechanical strength, extrusion processability, flexibility and colouring property. However, with recent concern for the global environment, halogen-free resin material has come to be used for the production of automobile parts including the covering of electrical wires in an automobile in place of polyvinyl chloride, because polyvinyl chloride discharges a harmful halogen gas on combustion.

A halogen-free resin composition in which a metal hydroxide is blended with a polyolefin-base polymer as a flame-retardant is known as a wear resistant resin composition having the merit of no generation of a poisonous gas such as a halogen gas on combustion (see JP-A-7-176219, JP-A-7-78518 and the like). In order that such a flame-retarding resin composition has a self-extinction property, a large quantity of a metal hydroxide is required to be added; however, this causes problems that mechanical strength such as the wear resistance, tensile strength and the like of the composition are much reduced. In order to prevent the deterioration of mechanical strength, it may be considered that amounts of a polypropylene having a comparatively high hardness and a high density polyethylene are increased, but the flexibility of the covered electrical wire is reduced thereby and the processability becomes poor.

Various specific prior art proposals in this field will now be mentioned.

JP-A-6-290638 discloses resin compositions containing metal hydroxide for electrical wire insulation, in which the resin composition is based on polypropylene (>80%). Additional components are polyethylene modified with acid anhydride and styrene copolymer.

U.S. Pat. No. 5,561,185 describes resin composition for electrical wires containing metal hydroxide, in which the resin components are (a) 40–88.5% by weight of propylene which is 50% by weight or more of a ethylene/propylene random copolymer, (b) 1.5 to 30% by weight of a polyethylene modified with carboxylic acid derivative, e.g. maleic anhydride and (c) 10 to 48% by weight of an ethylene-series copolymer, typically ethylene/vinyl acetate copolymer.

U.S. Pat. No. 5,180,889 also describes a resin composition containing metal hydroxide as a covering of conductors in a crush resistant cable assembly. The resin components are (a) a low density copolymer of ethylene and alpha-olefin, (b) an elastomeric styrene-ethylene-butylene-styrene triblock copolymer, preferably modified with maleic anhydride and (c) optionally an impact propylene and copolymer or polypropylene. Component (a) in the examples is 50% by weight or more of the total resin components.

SUMMARY OF THE INVENTION

An object of the present invention is to provide a halogen-free olefin-based resin composition comprising a mixture of selected components providing a good balance of properties, for example wear resistance, flame resistance, tensile property, flexibility and the like that are required for the covering material of an electrical wire, e.g. for an automobile.

The present invention provides a non-crosslinking and wear resistant halogen-free resin composition having good mechanical strength without loss of flexibility and being suitable for extrusion as an electrical wire covering and readily processable.

The present invention provides a resin composition containing the components:

(a) 40–90 parts by weight of a block copolymer of polypropylene segments and ethylene-propylene copolymer segments which is modified with acid anhydride and in which the polypropylene segment content is in the range 5–50% by weight, (b) 60–10 parts by weight of a styrene-based polymeric elastomer, wherein the total of components (a) and (b) is 100 parts by weight and no other resin component is present in the composition, and (c) 30–200 parts by weight of a metal hydroxide based on 100 parts by weight of the components (a) and (b).

DETAILED DESCRIPTION OF PREFERRED EMBODIMENTS

The respective components contained in the composition of the present invention are selected to provide the desired properties and are illustrated as follows.

Component (a) is an elastomeric block copolymer of polypropylene segments and ethylene-propylene copolymer segments, modified with acid anhydride, preferably 0.1 to 10% by weight of acid anhydride. The amount of the polypropylene segments in the polymer is in the range 5 to 50% by weight, preferably 15 to 45%. The polypropylene forms hard segments in the molecule while the ethylene-propylene copolymer forms relatively soft segments.

This copolymer, modified with a carboxylic acid anhydride, may be a copolymer prepared by either a graft process or a direct process.

The graft process is a process of previously copolymerizing polypropylene with ethylene-propylene copolymer and then grafting 0.1–10% by weight of an acid anhydride, by means of a peroxide or the like. The direct process is a process of copolymerizing a polypropylene with ethylene-propylene copolymer in the presence of 0.1–10% by weight of an acid anhydride.

Component (a) preferably has a melt flow rate (MFR) in the range of 0.1–5 g/10 min. MFR is an indicator of molecular length. The range 0.1–5 g/10 min is selected to achieve good cold weather performance, particularly avoidance of cracking. MFR is measured in accordance with JIS K6921-2, the entire disclosure of which is incorporated herein by reference. As described in JIS K6921-2, melt flow rate is measured using a load of 2.16 kgf at 230° C.

The amount of component (a) is 40–90 parts by weight in the total amount of the polymers (a) and (b) of 100 parts by weight, and is preferably 60–85 parts by weight. When the proportion of the component (a) exceeds 90 parts by weight, the wear resistance of the composition is reduced. On the other hand, when it is less than 40 parts by weight the composition has reduced flexibility and becomes hard.

The styrene-based polymeric elastomer, component (b), is a polymeric elastomer containing styrene. The styrene-based elastomer is preferably a polymer obtained by block-copolymerizing styrene with butadiene, and saturating double bonds of the resulting block-copolymer by hydrogenation (known as SEBS). Typically the ratio of the styrene/butadiene is in the range 3/7 to 2/8 by weight. Alternatively there is used for example a styrene-based elastomer obtained by block polymerizing styrene and isoprene and hydrogenating the double bonds of the block copolymer (this product can be regarded as polystyrene-poly(ethylene-propylene)polystyrene, and is known as SEPS). The styrene-based elastomer (b) may be modified with 0.1–10% by weight of a carboxylic acid anhydride. In this case the polymer may be prepared by a graft process or a direct process.

The amount of the styrene-based elastomer (b) in the total amount of 100 parts by weight of polymers (a) and (b) in the composition is 10–60 parts by weight, and preferably 15–40 parts by weight. When the proportion of component (b) exceeds 60 parts by weight, the wear resistance of the resin composition is not improved. On the other hand, when its proportion is less than 10 parts by weight, the flexibility of the composition is poor.

The acid anhydride of component (a), and optionally also component (b) is an organic carboxylic acid anhydride, typically an unsaturated acid anhydride, preferably maleic anhydride.

Magnesium hydroxide, aluminum hydroxide and the like can be used as the metal hydroxide (c). It is preferable that the metal hydroxide particles are surface-treated with a coupling agent, particularly a silane coupling agent (for example, an aminosilane coupling agent, a vinylsilane coupling agent, an epoxysilane coupling agent, etc.) and optionally a surface-treating agent such as a higher aliphatic acid (for example, stearic acid, oleic acid, etc.) or the like. The silane coupling agent typically contains Si—O linkages which bond to the hydroxide. Particularly preferred is magnesium hydroxide or aluminum hydroxide surface-treated with a coupling agent, preferably a silane coupling agent, particularly an aminosilane coupling agent.

The amount of the metal hydroxide based on 100 parts by weight of the polymers (a) and (b) in the composition is 30–200 parts by weight, preferably 50–150 parts by weight and more preferably 70–100 parts by weight.

Both components (a) and (b) are selected to be halogen-free. Synthetic resin components other than components (a) and (b) are substantially, and preferably completely, absent.

Compounding agents usually included in an olefin- based resin, such as for example an oxidation inhibitor, a copper inhibitor, a lubricant and the like may be added into the resin composition of the present invention provided that the above-mentioned properties are not unacceptably deteriorated. These and other conventional additives will be readily apparent to those of ordinary skill in the art.

The resin composition of the present invention can be prepared by mixing and kneading the above-mentioned respective components by conventional methods.

The covering of an electrical wire, particularly an electrical wire for an automobile, by the resin composition of the present invention may be performed by a conventional method.

In particular, when a metal hydroxide surface-treated with an aminosilane coupling agent is used, the coupling agent bonds the metal hydroxide with the acid anhydride of the component (a) and, if present the acid anhydride of component (b). The coupling agent has a functional group reacting with the inorganic hydroxide and a functional group reacting with the organic anhydride. Also the epoxysilane and vinylsilane coupling agents have affinity to the hydroxide and the anhydride. Accordingly, the wear resistance of the resin composition is remarkably improved. Further, when an amino group exists on the lipophilic side of the silane coupling agent molecule, the reaction with polyolefin modified with an acid anhydride (i.e. component (a) and/or component (b)) advantageously suppresses the hydrophilic property of the amino group.

EXAMPLES

The present invention is more specifically illustrated by the following non-limiting Examples and Comparative Examples.

Examples 1–2 and Comparative Examples 1–5

The components shown in Tables 1 and 2 are mixed at the amounts shown (parts by weight), and kneaded at 250–260° C. by a twin-screw extruder.

The composition obtained was extrusion-molded at a covering thickness of 0.3 mm around a conductor (twisted wire that consists of 7 soft copper wires, each having a diameter of 0.32 mm) having a cross-section of 0.5 $mm^2$. A die having a diameter of 1.6 mm and a nipple having a diameter of 1.0 mm were used for extrusion molding. The extrusion temperature was 210–230° C. for the die and 200–240° C. for cylinders, and the extrusion molding was carried out at a linear velocity of 100 m/min.

The meanings of the abbreviations in the Tables are as follows.

MAH-PP/EPR: a block copolymer of polypropylene with ethylene-propylene copolymer rubber, modified with 1% by weight of maleic acid anhydride. The MFR is in the range 0.1–5 g/10 min.

MAH-SEBS: a styrene-based elastomer obtained by saturating, by hydrogenation, the double bonds of a block copolymer of styrene and butadiene modified with 1% by weight of maleic acid anhydride (TUFTECH M1913 manufactured by Asahi Chemical Co., Ltd.).

SEBS: a styrene-based elastomer obtained by saturating double bonds of a block copolymer of styrene and butadiene by hydrogenation (TUFTECH H1041 manufactured by Asahi Chemical Co., Ltd.).

MAGNIFIN H51V: magnesium hydroxide surface-treated with an aminosilane coupling agent (manufactured by Alusuisse Martinswerk gmbh).

As an antioxidant, a hindered phenol-based antioxidant (trade mark "TOMINOX TT" manufactured by Yoshitomi Fine Chemicals Ltd.) was used.

The flame resistance and wear resistance obtained in Examples 1–2 and Comparative Examples 1–5 were measured in accordance with JASO (Japan Automobile Standards Organisation) D 611, the entire disclosure of which is incorporated herein by reference. The wear resistance is an average of 3 samples, and a value of 300 cycles or more is deemed acceptable.

The flexibility was evaluated by touch when the electrical wire was folded.

The processability was evaluated by the presence of a whisker formation on peeling at the terminal of the electrical wire.

The results are shown in Tables 1 and 2.

TABLE 1

| | Example 1 | Example 2 |
|---|---|---|
| MAH-PP/EPR (PP:EPR = 30:70, weight ratio) | 80 | 80 |
| MAH-SEBS | 20 | — |
| SEBS | — | 20 |
| MAGNIFIN H51V | 90 | 90 |
| Antioxidant | 1 | 1 |
| Flame resistance | acceptable | acceptable |
| Wear resistance | acceptable | acceptable |
| Flexibility | good | good |
| Processability | good | good |

TABLE 2

| | Comparative Example 1 | Comparative Example 2 | Comparative Example 3 | Comparative Example 4 | Comparative Example 5 |
|---|---|---|---|---|---|
| MAH-PP/EPR (PP:EPR = 30:70, weight ratio) | — | — | 100 | 95 | 20 |
| MAH-PP/EPR (PP:EPR = 2:98, weight ratio) | 80 | — | — | — | — |
| MAH-PP/EPR (PP:EPR = 60:40, weight ratio) | — | 80 | — | — | — |
| MAH-SEBS | 20 | 20 | — | — | 80 |
| SEBS | — | — | — | 5 | — |
| MAGNIFIN H51V | 90 | 90 | 90 | 90 | 90 |
| Antioxidant | 1 | 1 | 1 | 1 | 1 |
| Flame resistance | acceptable | acceptable | acceptable | acceptable | acceptable |
| Wear resistance | not acceptable | acceptable | acceptable | acceptable | not acceptable |
| Flexibility | good | bad | bad | bad | good |
| Processability | good | good | good | good | good |

The result of Comparative Example 1 shows that when the weight ratio of polypropylene in the copolymer of polypropylene with ethylene-propylene modified with an acid anhydride is too small, the wear resistance of the resin composition is not improved.

The result of Comparative Example 2 shows that when the weight ratio of polypropylene in the copolymer of polypropylene with ethylene-propylene modified with an acid anhydride is too high, the flexibility of the resin composition is poor.

The results of Comparative Examples 3 and 4 show that when the styrene-based elastomer is not present or its amount is little, the flexibility of the resin composition is low.

The result of Comparative Example 5 shows that when the amount of the styrene-based elastomer is too high, the wear resistance of the resin composition is not improved.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A resin composition comprising the components:

(a) 40–90 parts by weight of a block copolymer of polypropylene segments and ethylene-propylene copolymer segments, which is modified with acid anhydride and in which the polypropylene segment content is in the range 5–50% by weight, (b) 60–10 parts by weight of a styrene-based polymeric elastomer, wherein a total of components (a) and (b) is 100 parts by weight and substantially no other resin component is present in the composition, and (c) 30–200 parts by weight of a metal hydroxide based on 100 parts by weight of the components (a) and (b).

2. A resin composition according to claim 1 in which component (b) is a styrene-based polymeric elastomer modified with acid anhydride.

3. A resin composition according to claim 2, wherein at least one of components (a) and (b) is obtained by one of a graft process and a direct process.

4. A resin composition according to claim 1, wherein the acid anhydride of component (a) is maleic anhydride.

5. A resin composition according to claim 2, wherein the acid anhydride of component (b) is maleic anhydride.

6. A resin composition according to claim 1, wherein component (a) has a melt flow rate of 0.1–5 g/10 min as measured with a load of 2.16 kgf at 230° C.

7. A resin composition according to claim 1, wherein component (b) is a hydrogenated styrene-butadiene copolymer or a hydrogenated styrene-isoprene copolymer.

8. A resin composition according to claim 1, wherein component (c) is one of magnesium hydroxide surface-treated with a coupling agent and aluminum hydroxide surface-treated with a coupling agent.

9. A resin composition according to claim 8, wherein the coupling agent is a silane coupling agent.

10. A method of preparing a resin composition, comprising thoroughly mixing the following components:

(a) 40–90 parts by weight of a block copolymer of polypropylene segments and ethylene-propylene copolymer segments, which is modified with acid anhydride and in which the polypropylene segment content is in the range 5–50% by weight, (b) 60–10 parts by weight of a styrene-based polymeric elastomer, wherein a total of components (a) and (b) is 100 parts by weight, and (c) 30–200 parts by weight of a metal hydroxide based on 100 parts by weight of the components (a) and (b), substantially no other resin component being included in the composition.

11. A method according to claim 10, in which component (b) is a styrene-based polymeric elastomer modified with acid anhydride.

12. A method according to claim 11, wherein at least one of components (a) and (b) is obtained by one of a graft process and a direct process.

13. A method according to claim 10, wherein the acid anhydride of component (a) is maleic anhydride.

14. A method according to claim 11, wherein the acid anhydride of component (b) is maleic anhydride.

15. A method according to claim 10, wherein component (a) has a melt flow rate of 0.1–5 g/10 min as measured with a load of 2.16 kgf at 230° C.

16. A method according to claim 10, wherein component (b) is a hydrogenated styrene-butadiene copolymer or a hydrogenated styrene-isoprene copolymer.

17. A method according to claim 10, wherein component (c) is one of magnesium hydroxide surface-treated with a coupling agent and aluminum hydroxide surface-treated with a coupling agent.

18. A method according to claim 17, wherein the coupling agent is a silane coupling agent.

19. An electrical wire having an electrical conductor and a covering thereon made of a resin composition containing the components:

(a) 40–90 parts by weight of a block copolymer of polypropylene segment and ethylene-propylene copolymer segments, which is modified with acid anhydride and in which the polypropylene segment content is in the range 5–50% by weight, (b) 60–10 parts by weight of a styrene-based polymeric elastomer, wherein a total of components (a) and (b) is 100 parts by weight and substantially no other resin component is present in the composition, and (c) 30–200 parts by weight of a metal hydroxide based on 100 parts by weight of the components (a) and (b).

20. An electrical wire according to claim 19, in which component (b) is a styrene-based polymeric elastomer modified with acid anhydride.

21. An electrical wire according to claim 20, wherein at least one of components (a) and (b) is obtained by one of a graft process and a direct process.

22. An electrical wire according to claim 19, wherein the acid anhydride of component (a) is maleic anhydride.

23. An electrical wire according to claim 20, wherein the acid anhydride of component (b) is maleic anhydride.

24. An electrical wire according to claim 19, wherein component (a) has a melt flow rate of 0.1–5 g/10 min as measured with a load of 2.16 kgf at 230° C.

25. An electrical wire according to claim 19, wherein component (b) is a hydrogenated styrene-butadiene copolymer or a hydrogenated styrene-isoprene copolymer.

26. An electrical wire according to claim 19, wherein component (c) is one of magnesium hydroxide surface-treated with a coupling agent and aluminum hydroxide surface-treated with a coupling agent.

27. An electrical wire according to claim 26, wherein the coupling agent is a silane coupling agent.

* * * * *